US005471898A

United States Patent [19]

Forman

[11] Patent Number: 5,471,898

[45] Date of Patent: Dec. 5, 1995

[54] BREAKER BAR WITH 90 DEGREE ROTATING SOCKET CONNECTOR HEAD

[76] Inventor: Edward P. Forman, 1230 Honey Lake Rd., Lake Zurich, Ill. 60047

[21] Appl. No.: 170,514

[22] Filed: Dec. 20, 1993

[51] Int. Cl.[6] ..... B25B 17/00

[52] U.S. Cl. ..... 81/57.29; 81/57.13

[58] Field of Search ..... 81/57, 57.11–57.16, 81/57.28–57.31, 57.45

[56] References Cited

U.S. PATENT DOCUMENTS

| | | | |
|---|---|---|---|
| 1,199,823 | 10/1916 | Sadtler | 81/57.29 |
| 2,594,669 | 4/1952 | Marshall | 81/57.29 |
| 2,701,490 | 2/1955 | Griparis . | |
| 2,938,415 | 5/1960 | Kostka | 81/57.29 X |
| 3,733,936 | 5/1973 | Flynn . | |
| 4,086,829 | 5/1978 | Hudgins . | |
| 4,128,025 | 12/1978 | Main et al. . | |
| 4,262,561 | 4/1981 | Mize . | |
| 4,406,184 | 9/1983 | Cockman, Jr. . | |
| 4,474,089 | 10/1984 | Scott . | |
| 4,643,052 | 2/1987 | Badiali | 81/57.28 |
| 4,907,476 | 3/1990 | Singleton . | |

FOREIGN PATENT DOCUMENTS

| | | | |
|---|---|---|---|
| 500185 | 11/1945 | Italy | 81/57.29 |

*Primary Examiner*—James G. Smith
*Attorney, Agent, or Firm*—Leydig, Voit & Mayer

[57] ABSTRACT

A wrench for driving sockets is provided in the form of a breaker bar with a 90 degree torque rotation head. The wrench includes an elongate handle including a hand grip and a head portion including a cylindrical cavity and a longitudinal bore with an axis parallel to the handle. An intermediate cylindrical barrel is fixed to the head portion and also includes a central longitudinal bore. A central spindle is fixed to the handle and rotates within the cylindrical barrel and the head portion. Fixed to the end of the central spindle is a driving member. A driven member, rotated 90 degrees from the first, is fixed to a rotatable post. The post has a cylindrical portion, a rectangular solid portion for selectively receiving a socket wrench head, and a neck portion. The driven member engages the driven member preferably by way of a ball-driven arrangement such that rotation of the central spindle is translated to the post. Also included is a bearing block disposed within the cylindrical cavity of the head portion and having a cylindrical portion with a top face for providing a bearing surface for the driven member and a flat face for providing a bearing surface for the driven member. The bearing block also includes a central bore for receiving and journalling the cylindrical portion of the post. A journalling washer is also included for receiving and journalling a top surface of the driven member and the neck portion.

14 Claims, 5 Drawing Sheets

BREAKER BAR WITH 90 DEGREE ROTATING SOCKET CONNECTOR HEAD

FIELD OF THE INVENTION

The invention relates generally to hand tools, and more particularly to a breaker bar type socket wrench having a ninety degree torque rotation. A preliminary form of such breaker bar was disclosed in Disclosure Document No. 319398 filed in the United States Patent and Trademark Office on Oct. 26, 1992.

BACKGROUND OF THE INVENTION

Conventional socket wrench handles are constructed to provide leverage for turning the socket which is attached to the handle. The greatest application of torque can be applied by use of a breaker bar with a ninety degree socket connection. However, a ratchet mechanism may be typically located above the socket, and the handle extends radially away from the axis of socket rotation. In that way, swinging of the handle about its axis turns the socket. The ratchet mechanism is employed to permit swinging through a limited arc to effect rotation of the socket, and also to allow a lost motion movement where the handle is returned to its original position without moving the socket in the reverse direction.

Socket wrenches of this type often include a means for speed-driving of the nut once it has reached the finger tight position. That is, the higher torque ratcheting function is used either to tighten the nut from finger tight or to loosen it from fully tightened to finger tight. Thereafter, the ratcheting function is no longer used and the wrench employs another mechanism for further loosening or tightening of the nut. Often, this mechanism is a ninety degree drive consisting of bevel gears. An example of such a bevel-gear drive in combination with a transverse ratcheting function can be found in U.S. Pat. Nos. 2,701,490, 3,733,936, 4,086,829, 4,128,025, 4,262,561, 4,406,184, 4,907,476. In these wrenches, a bevel gear drive is employed to give the torque applied to a rotating handle a ninety degree rotation to allow for driving of the socket and speed tightening or loosening of an already loosened or tightened nut, respectively. However, these bevel-gear arrangements do not provide for enough external torque to be applied to the nut to fully loosen it or loosen it from fully tightened. As such, these wrenches must include the ratcheting function which provides for greater leverage and thus torque on the nut. However, these combined ratchet and bevel-gear drive wrenches suffer from the same drawback as conventional ratchet wrenches. That is, they cannot be effectively used if the available space is too limited to permit effective swinging of the handle. Further, provision of one set of components for speed loosening and another set for high-torque loosening or tightening is wasteful, and it would be desirable if a single set of components could provide both functions.

An example of a bevel-gear wrench that does not also employ a transverse ratcheting function for high-torque situations can be seen in U.S. Pat. No. 4,474,089 to Scott. However, the device disclosed in that patent includes a circumferential ratchet which provides a ratcheting function upon twisting of the handle. Thus, the torque applied to the rotating bevel-gear drive is carried through a ratchet. Again, such a configuration has more moving parts than are desirable and it would be preferable to provide fewer parts that give the same performance. Further, use of such a ratchet requires some degree of play in the ratcheting mechanism.

In high speed use, such play can lead to unwanted slop. Further, ratchet mechanisms do not provide for a large amount of contact between the pawl and the ratchet wheel being controlled. When high torques are applied, the small contact area can lead to possible stripping of the ratcheting mechanism.

SUMMARY OF THE INVENTION

Accordingly, it is a primary aim of the present invention to provide a handle for socket wrenches or similar tools wherein the socket projection or lug may be rotated by a simple turning motion that is axial to the handle without the necessity for swinging and that provides for high external torque and high speed performance with a minimal number of parts giving good performance and durability.

In achieving that aim, it is an object of the present invention to provide a wrench for sockets that includes a ninety degree torque rotation socket head that is capable of delivering high torque without the need for ratcheting mechanism and with the fewest number of parts.

It is a related object of the invention to provide a ninety degree torque rotation socket wrench that prevents stripping of the wrench for high-torque levels.

It is a further object of the invention to provide a ninety degree torque rotation socket wrench which provides for a minimum of flexing or relative movement between the bevel-drive gears.

It is a related object of the invention to provide a ninety degree torque rotation socket wrench that is well-suited for high-speed use.

It is a further related object to provide a ninety degree torque rotation socket wrench that does not suffer from slop problems.

It is a further object of the invention to provide a ninety degree torque rotation socket wrench that gives good performance at all speeds and magnitudes of applied torques, and that similarly gives good performance for all nut torques being driven.

It is a feature of the present invention that the minimum number of parts making up the ninety degree rotation socket wrench are well-journalled within the body of the wrench, and have good support. The novel design of the wrench according to the invention gives the wrench these features, which, in turn, achieves the objectives referred to above. According to the present invention, there is provided a breaker bar with a ninety degree torque rotation socket connector head. The wrench includes an elongate handle having a hand grip, and a head portion. The head portion includes a cylindrical cavity the axis of which is perpendicular to the axis of the handle. The head portion includes a longitudinal bore parallel to the handle. Between the elongate handle and the head portion is an intermediate cylindrical barrel that is fixed to the head portion and includes a central longitudinal bore. A central spindle is fixed to the elongate handle and is journalled for rotation within the cylindrical barrel and the head portion. Attached to the end of the central spindle is a driving member. A driven member is fixed to a rotating post which is disposed along an axis perpendicular to the central spindle. The rotating post has a cylindrical portion and a rectangular solid portion for selectively receiving a socket wrench head. The driven member engages the driving member such that rotation of the central spindle is translated to the post and thus rectangular solid portion. The wrench also includes a bearing block disposed within the cylindrical cavity in the head portion. The bearing block has a generally cylindrical shape including a top face serving as a bearing surface for the driven member. The roughly cylindrical shape also includes a flat face. This flat face is adapted to provide a bearing surface for the driving member. The bearing block also includes a central bore for receiving and journalling the cylindrical portion of the post. Also included is a journalling washer for journalling and supporting the top surface of the driven member. By means of the bearing block and journalling washer, the few components of the wrench according to the present invention are well supported and journalled, giving them the advantageous features referred to above. In the preferred form a unique ball-driven arrangement is used with the driven and driven members.

DETAILED DESCRIPTION OF THE PREFERRED EMBODIMENTS

While the invention will be described and disclosed in connection with certain preferred embodiments, it is not intended to limit the invention to these specific embodiments. Rather, it is intended to cover all such alternative embodiments and modifications that fall within the scope of the invention as defined by the appended claims.

Figure 1:
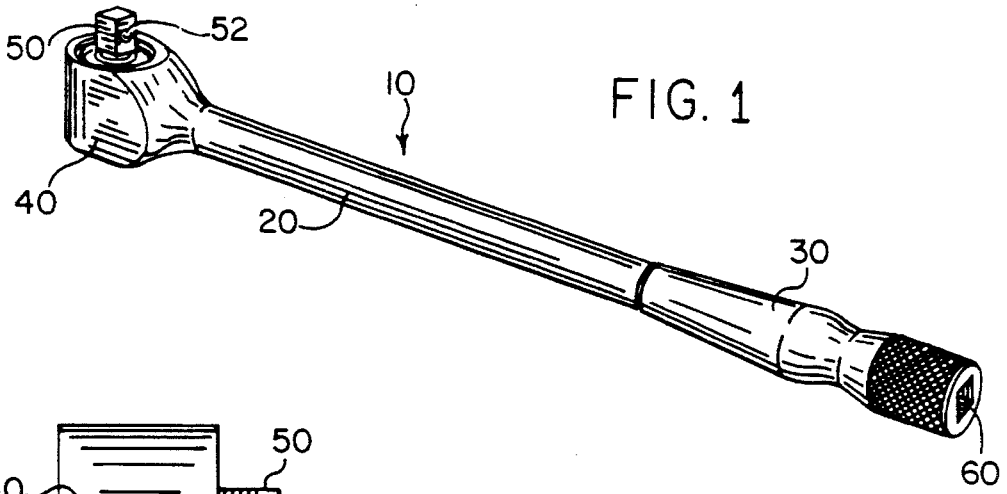
FIG. 1 is a perspective view of a socket wrench with 90 degree rotating head according to one embodiment of the present invention.

Turning now to the drawings, FIG. 1 shows a representative example of a socket wrench according to the present invention. The socket wrench 10 includes an intermediate cylindrical barrel 20 extending between a rotating handle 30 and a head 40 adapted for receiving a standard socket for driving a nut or the like. The head 40 includes a rectangular solid portion 50 for selectively receiving a conventional socket (not shown). As will be shown, rectangular solid portion 50 may contain a spring loaded ball bearing to maintain proper engagement with a socket. In operation, rotational movement of handle portion 30 is translated into rotational movement of rectangular solid portion 50, and thus, rotation of the socket. Rotation of the handle portion 30 may either be by hand, or by means of another wrench or power driven tool fitted into the wrench-receiving socket 60 in the handle portion 30.

Figure 2:
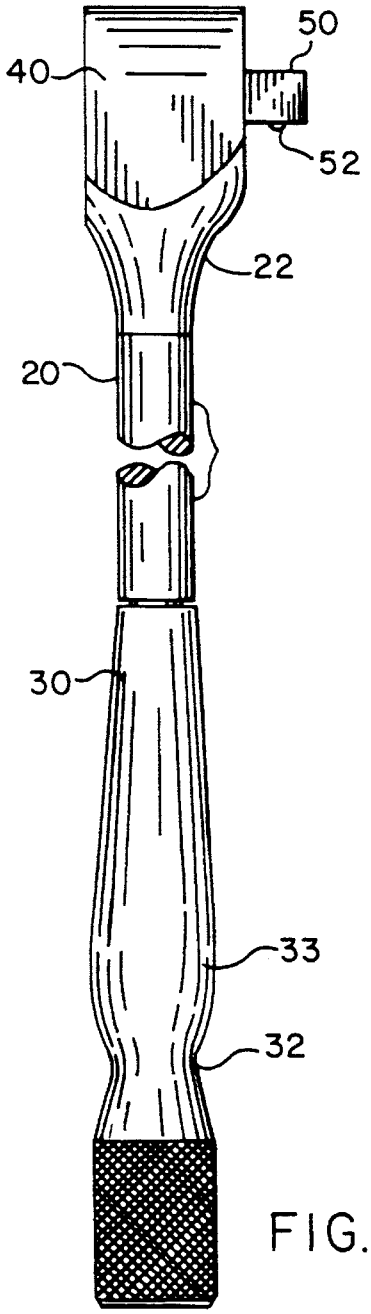
FIG. 2 is an elevational side view of a socket wrench with 90 degree rotating head according to one embodiment of the present invention.
Figure 3:
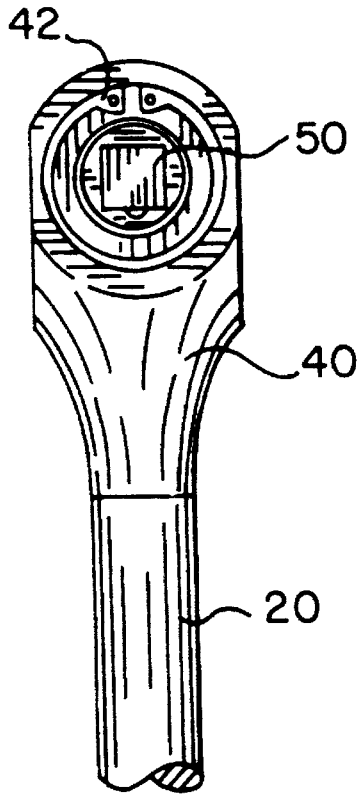
FIG. 3 is an elevational front view of the socket wrench with 90 degree rotation according to one embodiment of the present invention.
Figure 4:
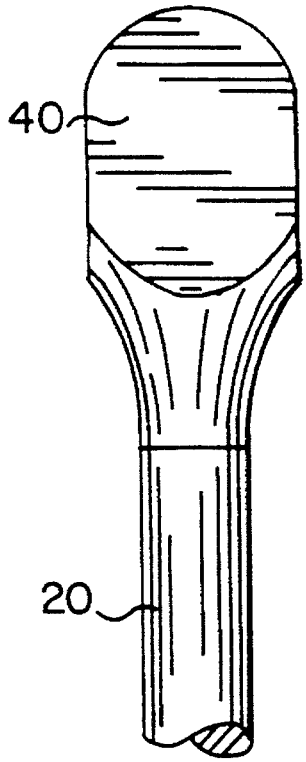
FIG. 4 is an elevational rear view of the socket wrench with 90 degree rotating head according to one embodiment of the present invention.
Figure 5:
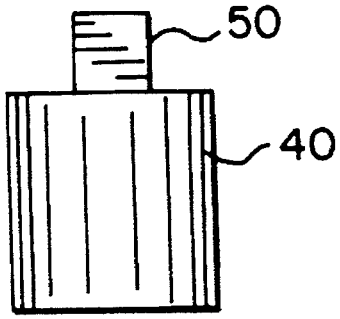
FIG. 5 s an elevational top view of the socket wrench with 90 degree rotating head according to one embodiment of the present invention.
Figure 6:
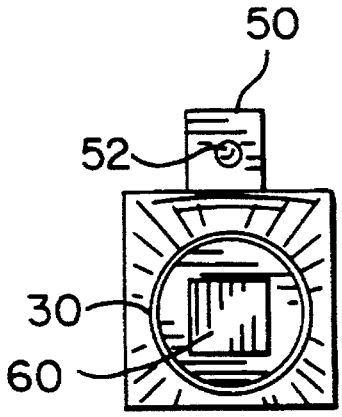
FIG. 6 s an elevational bottom view of the socket wrench with 90 degree rotating head according to one embodiment of the present invention.

FIGS. 2–6 show various elevational views of a socket wrench according to the present invention. FIG. 2 shows that the handle portion 30 is contoured to include a circumferential depression 32 and an increased circumferential ridge 33 to allow easy grasping for manual rotation of the handle 30, which rotation is translated through the head 40 to the rectangular solid portion 50. Also shown is the smooth, flaring contour 22 from the diameter of elongated portion 20 to the expanded region of the head portion 40. FIG. 3 further shows this gradual contour. FIG. 3 also shows a front view of the head 40, including rectangular solid portion 50. Also shown is a retaining ring 42. The retaining ring, as will be discussed below, is adapted to retain the components housed within the head portion 40 in their respective positions. FIG. 4 shows a rear view of the same head portion 40. Comparison of FIG. 4 and FIG. 2 reveals that this rear portion of head 40 is flat and does not have any projections away from that flat surface. FIG. 5 shows a top view of the head 40 and the rectangular solid portion 50 extending therefrom. The wrench-receiving socket 60 is clearly seen in the bottom elevational view of FIG. 6. The exterior views of FIGS. 1–6 show that the socket wrench according to the invention is simple in design and has a sleek profile to allow the wrench 10 to reach nuts that are not readily accessible to the hand or to other conventional wrenches. In addition to this sleek profile and simple design, the wrench 10 also includes advantageous functional characteristics which will be described below.

Figure 8:
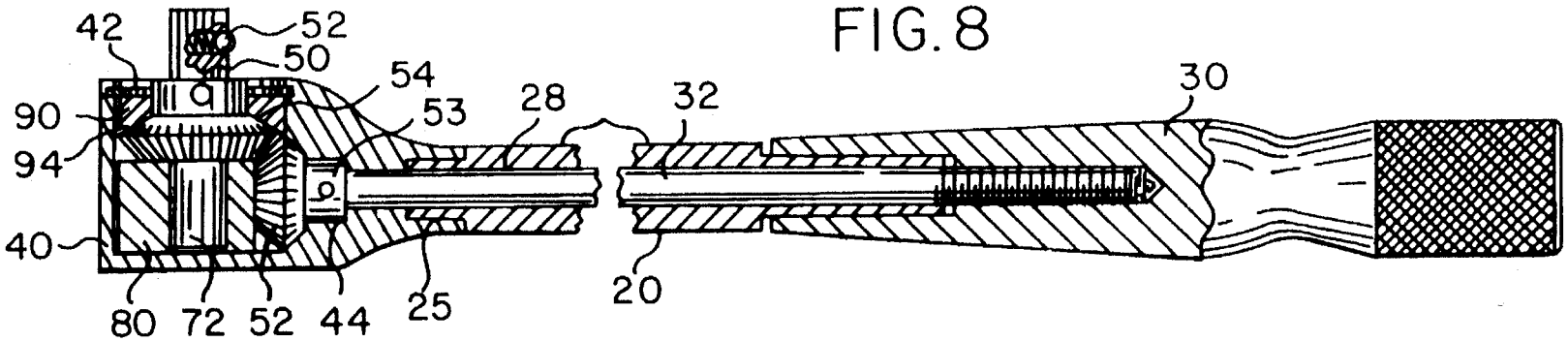
FIG. 8 is a sectional view of the socket wrench with 90 degree rotating head according to one embodiment of the present invention.
Figure 7:
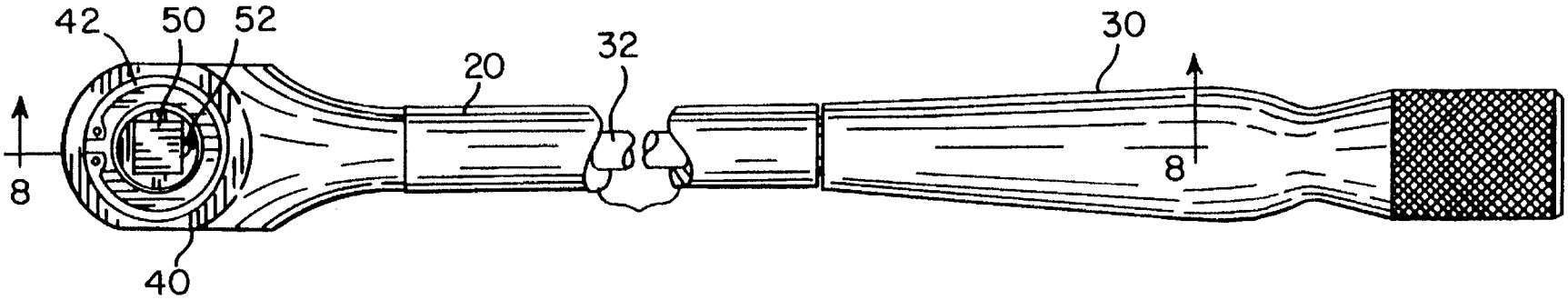
FIG. 7 s a full elevational front view of the socket wrench with 90 degree rotating head according to one embodiment of the present invention.

The components comprising a socket wrench according to this embodiment of the invention can be clearly seen in the sectional view of FIG. 8. The intermediate cylindrical barrel 20 is journalled for rotation within the handle 30. The intermediate cylindrical barrel 20 is fixed with respect to the head portion 40 at the joint designated by reference numeral 25. Both the intermediate cylindrical barrel 20 and the head portion 40 include a central longitudinal throughbore 28. Journalled within the central throughbore 28, for rotation with respect thereto, is a central spindle 32. The central spindle 32 is fixed to the handle 30, and serves to translate the rotation of the handle 30 into the bevel drive gear to be discussed in detail below.

To translate the rotational motion of the handle 30 to rotational motion of the rectangular solid portion 50, and thus the attached socket, a 90 degree drive is included. The 90 degree drive according to the invention includes a driving member fixed to the central spindle and a driven member which is engaged by the driving member and which is coupled to the rectangular solid portion 50. In this embodiment, the 90 degree drive is in the form of a drive comprising complemental bevel gears. The driving member is bevel gear 52, while the driven member is bevel gear 54. Bevel gear 52 is fixed to the central spindle 32, and rotates therewith. Head portion 40 includes a recess 44 in communication with throughbore 28, that receives bevel gear 52 and its associated neck portion 53. The shape of recess 44 is made to conform to bevel gear 52 and neck 53 in such a way that the bevel gear is well-journalled within that recess 44. Bevel gear 52 interacts with bevel gear 54 to translate the rotation of the handle 30 to the rectangular solid portion 50. As will be discussed below, bevel gear 54 is also journalled within head portion 40.

Figure 9:
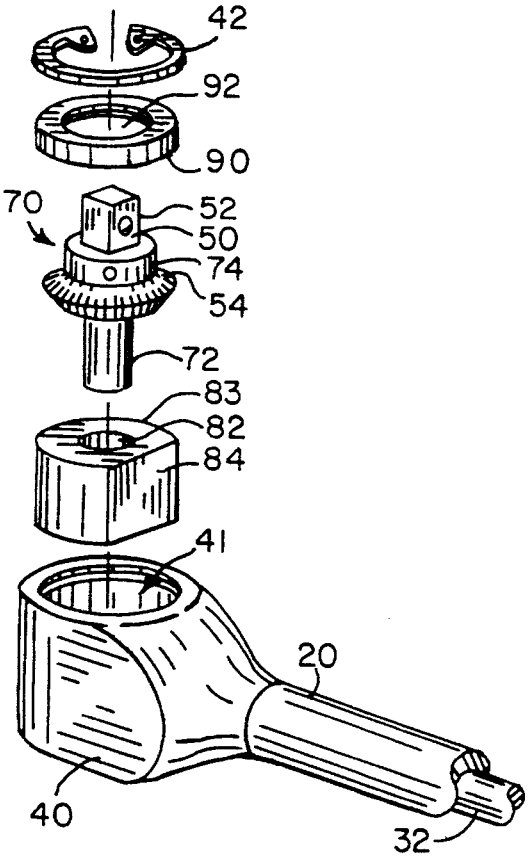
FIG. 9 is an exploded view of components housed within the head portion of the socket wrench with 90 degree rotating head according to one embodiment of the invention.

To provide for support of the bevel gears 52, 54 within the head portion 40, a bearing block and journalling washer are included. The bearing block 80 can be seen in the cross-section in FIG. 8, as can journalling washer 90. Both components, however are seen more clearly in the exploded view of FIG. 9. Also shown in FIG. 9 is the rotatable post 70 which includes bevel gear 54 and rectangular solid portion 50. The rotating post 70 also includes a cylindrical portion 72. Cylindrical portion 72 provides post 70 with a stable axis of rotation. The cylindrical portion 72 comprises one end of the post 70, while rectangular solid portion 52 is at the opposite end. Bevel gear 54 is disposed intermediate the ends. A neck portion 74 between bevel gear 54 and rectangular solid portion 50 interacts with journalling washer 90 to provide greater stability to the structure as will be discussed below. Cylindrical post 72 is journalled within a central bore 82 of the bearing block 80. To add further support to post 70, bearing block 80 also includes an upper bearing face 83 for receiving bevel gear 54. The bearing block 80 is, in turn, journalled within the cylindrical cavity 41 of the head portion 40. The cylindrical cavity 41 is designed to tightly receive the cylindrical portion of bearing block 80. With bearing block 80 firmly received within cavity 41 and cylindrical post 72 journalled within central bore 82 of the bearing block, and bevel gear 54 bearing on bearing surface 83, post 70 and its associated bevel gear 54 are well supported within head portion 40.

To further add to the support and journalling of post 70 and associated bevel gear 54 within the head portion 40, a journalling washer 90 is also included. Journalling washer 90 includes a central bore 92 for journalling the neck portion 74 of the post 70. As can be seen in the sectional view of FIG. 8, the journalling washer 90 also includes an angled interior face 94, which receives the angled upper surface of the bevel gear 54. A retaining ring 42 fits within a circumferential groove in cylindrical cavity 41 and secures the journalling washer 90 into place within the head portion 40. The combination of retaining ring 42, journalling washer 90 and bearing block 80 ensure that post 70 and its associated bevel gear 54 are well journalled and supported for rotation within the head portion 40. Because of the arrangement of these components, flexing of the post 70 due to external torques and forces is prevented.

To provide bearing and support of the bevel gear 52 within the head portion 40, bearing block 80 also includes a flat face 84. Flat face 84, which is perpendicular to the top surface of bevel gear 52 provides a bearing surface for bevel gear 52, and, in combination with recess 44 in the head portion 40 journals and supports bevel gear 52 within the head portion 40. This journalling and support, again, prevents flexing of the bevel gear 52 due to external torques.

The journalling and support of bevel gears 52 and 54 within the head portion 40 provides several advantages. Since flexing of the bevel gears is prevented, a greater external torque can be applied to the handle 30 without stripping of the bevel gear drive. That is, the journalling and support of the bevel gears 52, 54 ensures that their mesh is constant over a broad range of externally-applied torques. This allows, for instance, the handle portion to be power driven by a separate instrument without a risk of the bevel drive stripping. Further, the journalling and support of the bevel gears also allows for high speed operation of the bevel gear drive. Since the mesh of the gears is so complete, there is very little slop between them. Reliable, high speed operation results.

Figure 10:
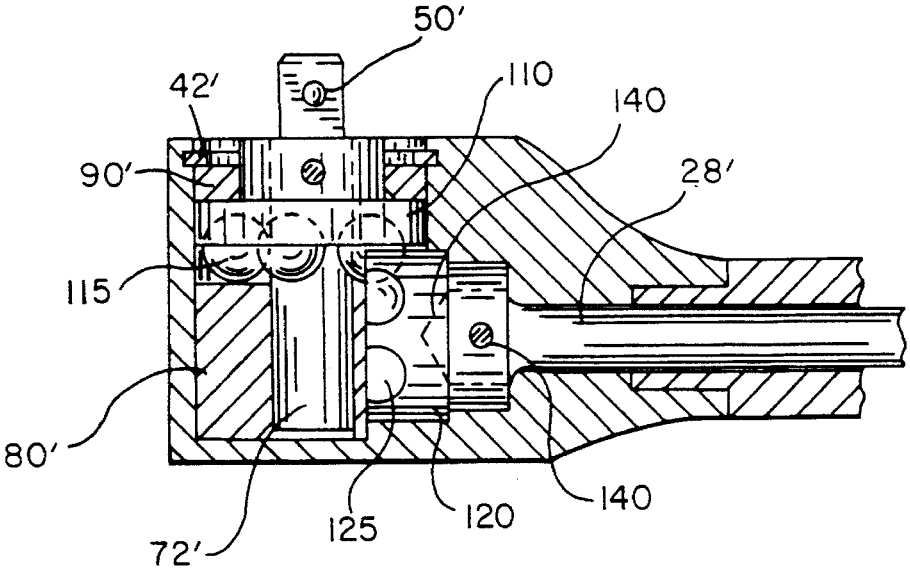
FIG. 10 is a partial sectional view of the socket wrench with 90 degree rotating head according to a second embodiment.
Figure 11:
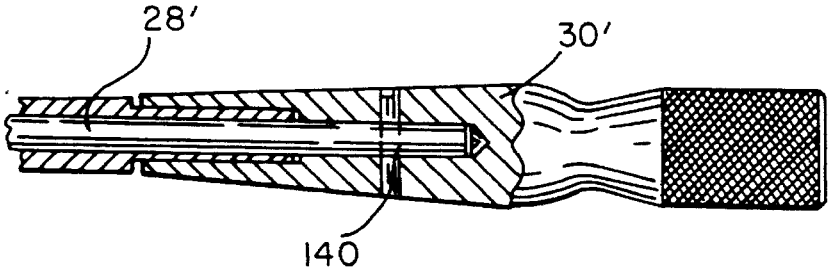
FIG. 11 is a further partial view of the socket wrench with 90 degree rotating head according to a second embodiment.

According to an alternative and preferred embodiment of the invention, the 90 degree drive is in the form of a unique ball-driven arrangement. This ball drive is illustrated in FIG. 10–14. Both this wrench and the one previously discussed have several similar components. The primed reference numbers in FIGS. 10–14 represent such components. Turning to FIG. 10, the ball drive according to this embodiment of the invention is shown. The driven member consists of a driven plate 110 into which a plurality of drive balls 115 are fixed. The driving member is a drive plate 120 which includes a plurality of recesses 125 which are complemental to the drive balls 115. In this manner, rotation of drive plate 120 causes successive recesses 125 to engage successive drive balls 115, thus transferring torque to the drive plate 110. The drive plate 110 is, in turn, fixed to a rotatable post 72', including a rectangular solid portion 50' for receiving a socket wrench head. Drive plate 120 is fixed to central spindle 28' for rotation therewith. In turn, and as can be seen in FIG. 11, the other end of spindle 28' is fixed in handle portion 30' by means of a retaining pin 140. According to this arrangement, a torque applied to handle 30' is translated into rotational motion of rectangular solid portion 50' for the purpose of loosening or tightening a nut.

Figure 12:
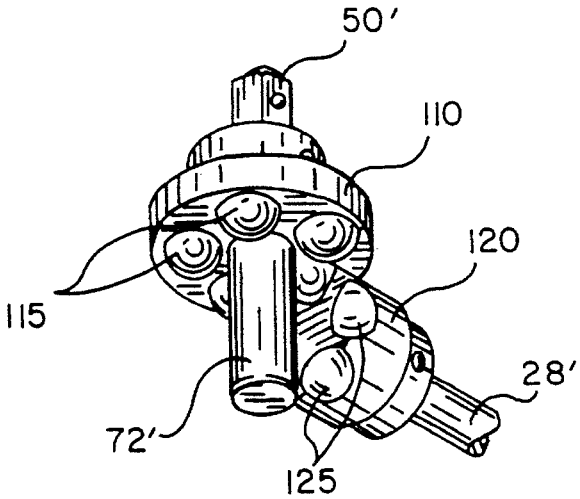
FIG. 12 is a perspective view of the driving member and driven member according to the second embodiment.
Figure 13:
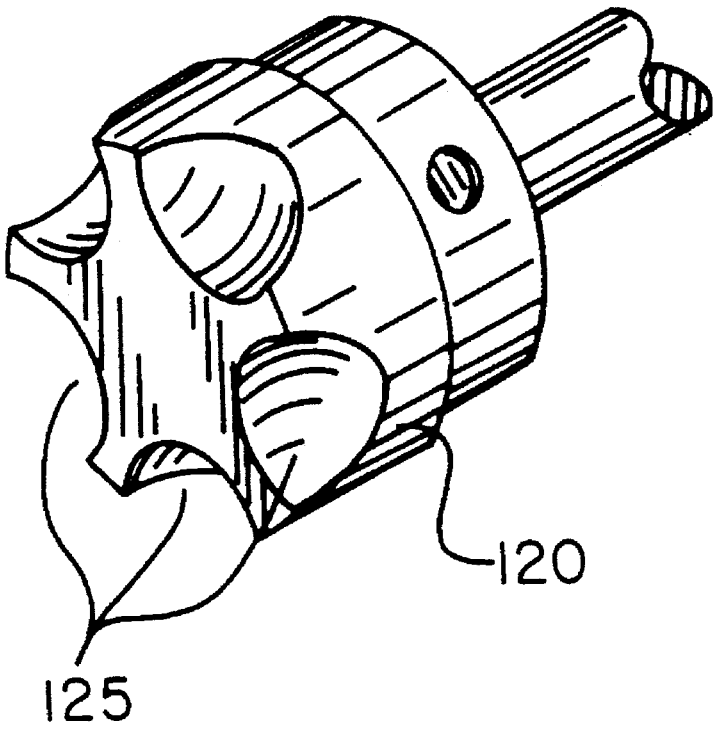
FIG. 13 is a perspective view of the driving member according to the second embodiment.
Figure 14:
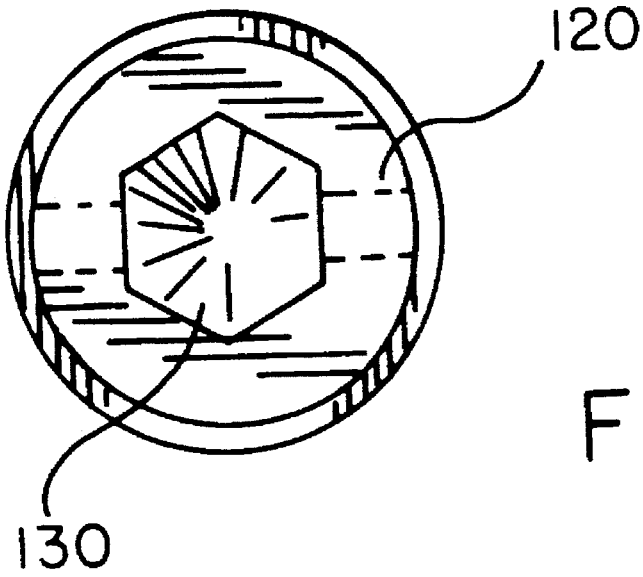
FIG. 14 is a elevational view of the rear face of the driving member according to the second embodiment.

The drive plate 120 and driven plate 110 are shown in greater detail in the perspective view of FIG. 12. This form of drive gives the wrench significant torque capabilities due in large part to the increased surface area of contact between drive plate 120 and driven plate 110, as compared to the bevel gear system previously described. The depressions 125 are shaped so as to engage an entire quarter-spherical surface area of a drive ball 115 when the drive ball and the depression are in engagement. This relationship can be seen most clearly in reference to both FIG. 12 and to FIG. 10. This extended contact area, because of its spherical shape, is well supported in several directions. Drive balls 115 and depressions 125 are further designed so that two different drive balls 115 can be in engagement with two different depressions 125 simultaneously. Thus, as drive plate 120 turns, and a leading drive ball 115 is engaged by a leading depression 125, the following drive ball 115 is seated within the following depression 125 before the lead drive ball is disengaged from the lead depression 125. The configuration of drive plate 120 and depressions 125 In this manner is seen most clearly in FIG. 13. This makes the ball drive smooth in operation and also enhances its torque capabilities. Further, drive balls 115 are braised into hemispherical depressions in the drive plate 110, and are thus not subject to any translation or rotational movement. This variety of factors sums together to make the ball drive shown in FIG. 12 highly stable and smooth in operation. A 90 degree torque rotation wrench according to the invention and including this ball drive is capable of successfully withstanding applied torques of 2,000 foot pounds.

Because of the stability and high torque capability of the ball drive, other components of the wrench must have enhanced torque capabilities to withstand the larger torque ranges provided by the ball drive. Toward that end, and as mentioned previously, central spindle 28', according to this embodiment, is pinned to the handle 30. The other end of central spindle 28' is fixed for rotation with the drive plate 120. To increase the torques stability of this engagement, central spindle 28 is hexagonally shaped. Similarly, the receiving hole in the drive plate 120 is also hexagonally shaped. This receiving hole, and its hexagonal shape can be seen most clearly in FIG. 14. The hexagonal receiving hole 130 may illustratively be broached into the drive plate 120. Returning to FIG. 10, the hexagonal head of the drive shaft 28' may taper to a point at its end as at 140. Of course, hexagonal receiving hole 130 would be similarly dimensioned. The hexagonal shape of the shaft 28 and the receiving hole 130 gives the connection between the shaft 28' and the drive plate 120 significantly increased torque stability over a circular shaft and receiving hole. The shaft is further fixed for rotation with the driving plate by means of a pin 140.

The torque wrench according to this embodiment also includes many of the advantageous journalling and stability features of the previous embodiment. In particular, a generally cylindrically bearing block 80' is included. Drive balls 115 are adapted to ride on the top face of the drive block 80' while the drive plate 120 abuts its flat side face. A central throughbore in the bearing block 80' receives the cylindrical post 72' to which the driven plate 110 is fixed. A journalling washer 90' is also included above the driven plate 110. A retaining ring 42' maintains journalling washer 90' in place. With all of these components housed within the head portion, the ball drive and the rotatable post are well journalled and supported for reliable operation.

It will be appreciated by one skilled in the art that various modifications could be made to the present invention. As a representative example, the proportion between bevel gear 52 and 54 of the first embodiment could be modified with respective modifications to the shape of bearing block 80 and journalling washer 90. Further, rectangular solid portion 50 could be modified to include a spring-loaded ball bearing 52 as seen in FIG. 8. This would allow for more secure retention of a socket used in conjunction with the wrench 10. Other modifications could be made while still staying within the spirit and scope of the invention. Overall, the present wrench gives superior performance in terms of high speed capability and resistance to stripping under high torque situations. At the same time, the wrench delivers this advantageous function with a simple design and small number of moving parts, particularly in comparison to prior art wrenches.

What is claimed is:

1. A wrench for driving sockets in the form of a breaker bar having a ninety degree torque rotation head, comprising in combination:

a) an elongate handle;

b) a head portion including a cylindrical cavity having a first axis perpendicular to the handle (c) an intermediate cylindrical portion disposed between the handle and head and fixed to the head, and including a central longitudinal throughbore having a second axis parallel to the handle;

c) a central spindle fixed to the handle and journalled for rotation within the longitudinal throughbore;

d) a driving member including a flat face, a body portion and a neck portion, the neck portion being fixed to an end of the central spindle such that the driving member rotates therewith;

e) a driven member fixed to a rotatable post the post being disposed parallel to the first axis, the post including a cylindrical portion and a rectangular solid portion for selectively receiving a socket wrench head, the driven member engaging the driving member such that rotation of the central spindle is translated to the post;

f) a generally cylindrical bearing block disposed within the cylindrical cavity, having a cylindrical portion with a top face providing a bearing surface for the driven member, the bearing block also including a flat face in bearing contact with the flat face of the driving member to provide a bearing surface for the driving member, the bearing block also including a central bore for receiving and journalling the cylindrical portion of the post, the cylindrical cavity including bearing surfaces in bearing contact with the body portion and the neck portion of the driving member, the driven member comprising a driven plate including a radial center, the driven plate having drive balls of a given diameter fixed thereto and recessed therein, the drive balls being radially spaced from the radial center and circumferentially spaced about the driven plate.

2. The wrench according to claim 1 including a journalling washer for receiving and journalling a top surface of the driven member.

3. The wrench according to claim 2, wherein a retaining ring engages the cylindrical cavity in the head portion thereby securing the post, the bearing block and the journalling washer within the cavity.

4. The wrench according to claim 1, wherein the head portion includes a recess for receiving the driving member, the recess being in communication with the central longitudinal throughbore.

5. The wrench according to claim 1, wherein the cylindrical cavity is sized to tightly receive the cylindrical portion of the bearing block.

6. The wrench according to claim 1, wherein the rectangular solid portion includes a spring-loaded ball bearing for effecting engagement with attached sockets.

7. The wrench according to claim 1, wherein the elongate handle includes a wrench-receiving socket.

8. The wrench according to claim 7, wherein the elongate handle is contoured to provide manual gripping and includes a circumferential depression and a radially increased circumferential ridge.

9. The wrench according to claim 1, wherein the driving member comprises a drive plate, the drive plate having spherical depressions therein which are complemental to the drive balls for receiving and supporting successive drive balls as the drive plate is rotated, the depressions being circumferentially spaced about the drive plate.

10. The wrench according to claim 9, wherein the drive balls are brazed into spherical depressions in the driven plate.

11. The wrench according to claim 1, wherein the central spindle has a hexagonal cross-section.

12. The wrench according to claim 11, wherein the driving member includes a hexagonal receiving hole for receiving the central spindle.

13. The wrench according to claim 1, wherein the central spindle is fixed within the handle by means of a retaining pin.

14. The wrench according to claim 9, wherein the spherical depressions are quarter-spherical in shape, so as to engage and support a quarter-spherical surface area of a drive ball when a drive ball and a spherical depression are in engagement.

* * * * *